US005266911A

United States Patent [19]

Perpall et al.

[11] Patent Number: 5,266,911

[45] Date of Patent: Nov. 30, 1993

[54] MULTIPLEXING SYSTEM FOR PLURAL CHANNELS OF ELECTROMAGNETIC SIGNALS

[75] Inventors: Robert C. Perpall; Ross Stramler, both of Manhattan Beach, Calif.; Joe Hall, Silverdale, Wash.

[73] Assignee: Hughes Aircraft Company, Los Angeles, Calif.

[21] Appl. No.: 961,050

[22] Filed: Oct. 14, 1992

Related U.S. Application Data

[63] Continuation of Ser. No. 811,639, Dec. 23, 1991, abandoned.

[51] Int. Cl.[5] ..... H01P 5/12; H01P 1/209

[52] U.S. Cl. ..... 333/135; 333/113; 333/134; 342/361; 343/756

[58] Field of Search ..... 333/110, 113, 114, 117, 333/135, 134, 137, 21 A, 208, 126, 21 R; 343/776, 853, 756, 858; 342/361, 365; 370/69.1

[56] References Cited

U.S. PATENT DOCUMENTS

| | | | |
|---|---|---|---|
| 2,595,680 | 5/1952 | Lewis | 333/110 |
| 2,667,620 | 1/1954 | Riblet | 333/114 |
| 4,780,694 | 10/1988 | Kich et al. | 333/137 X |
| 4,912,436 | 5/1990 | Alford | 333/135 |
| 4,970,480 | 11/1990 | Wong et al. | 333/135 |

*Primary Examiner*—Robert J. Pascal
*Assistant Examiner*—Seung Ham
*Attorney, Agent, or Firm*—Gordon R. Lindeen, III; Wanda K. Denson-Low

[57] ABSTRACT

A multiplexing system combines a plurality of electromagnetic signals to propagate along a common path, preferably a square waveguide which can be connected to an antenna feed horn of square cross section which can support both circularly and linearly polarized electromagnetic waves. The system is operative with a plurality of sets of signal channels including a first set of A-channel signals and a second set of B-channel signals. A circular polarizer connects with a first end of the waveguide. All of the A-channel signals are fed into an input port of the polarizer. The B-channel signals are coupled into the waveguide by a plurality of couplers located at positions arranged serially along the waveguide, individual one of the couplers operating at different ones of the B-channel frequencies for selectively coupling respective ones of said B-channel signals into the waveguide to propagate toward the second end of the waveguide. Each of the couplers has a rectangular waveguide and plural cylindrical cavity filters interconnecting a broad and a narrow wall of the rectangular waveguide with two contiguous walls of the square waveguide. Slotted apertures act to couple directionally the B-channel signal into the square waveguide to propagate towards the second end of the square waveguide. In one embodiment, an end of one filter contacts one waveguide, and an end of the second filter contacts the other waveguide. In a second embodiment, ends of both filters contact the square waveguide.

14 Claims, 3 Drawing Sheets

MULTIPLEXING SYSTEM FOR PLURAL CHANNELS OF ELECTROMAGNETIC SIGNALS

This is a continuation of application Ser. No. 07/811,639 filed Dec. 23, 1991 (now abandoned).

BACKGROUND OF THE INVENTION

This invention relates to microwave multiplexers operative with plural channels of electromagnetic signals and, more particularly, to the multiplexing signals of differing frequencies of a first set of signal channels with signals of differing frequencies of a second set of signal channels, wherein the first channel signals are circularly polarized and the second channel signals are linearly polarized prior to a combining of the two sets of signals.

Microwave multiplexers are employed in communication systems, such as in satellite communication systems, for combining numerous signal channels for transmission along a common transmission path such as an antenna feed. In a frequently employed form of satellite communication system, an antenna carried by a satellite transmits and/or receives electromagnetic signals propagating between the satellite and an antenna located on the earth's surface. Plural signal channels separated by frequency and/or by polarization are communicated by the two antennas. It is important that the signals of all the channels, whether they be linearly polarized or circularly polarized, propagate along the same path in a common direction so that all of the signals transmitted by a transmit antenna reach a receive antenna.

While multiplexing systems have been employed in both land-based and in satellite communication systems, a problem arises in that they have entailed mechanical complexity with undesirably heavy structures At present, multiplexing systems with adequate mechanical simplicity and reduced mass, suitable for use in satellite and ground-based communication systems are unavailable.

SUMMARY OF THE INVENTION

The aforementioned problems are overcome and other advantages are provided by a multiplexing system for combining a plurality of electromagnetic signals to propagate along a common path, preferably a square waveguide, which can be connected to an antenna feed horn of square cross section. Such a feed horn can support both circularly and linearly polarized electromagnetic waves. The square waveguide has opposed top and bottom walls and opposed sidewalls. Since the feed horn is common to both the circularly and the linearly polarized waves, an antenna reflector illuminated by the feed horn provides the same direction of radiation of signals at both of the polarizations.

The system is operative with a plurality of sets of signal channels including a first set of A-channel signals and a second set of B-channel signals. The system comprises the aforementioned square waveguide having a first end and a second end opposite the first end, and a circular polarizer having an input port and an output port, the output port being connected to the first end of the waveguide. All of the A-channel signals are fed into the input port of the polarizer. The A-channel signals differ in frequency from each other, and the B-channel signals differ in frequency from each other. All of the A-channel signal frequencies and all of the B-channel signal frequencies fall within a pass band of the waveguide, and all of the A-channel signals propagate through the polarizer and along the waveguide to the second end of the waveguide.

The B-channel signals are coupled into the square waveguide by a plurality of coupling means located at positions arranged serially along the waveguide, individual ones of the coupling means operating at different ones of the B-channel frequencies for selectively coupling respective ones of the B-channel signals into the square waveguide to propagate toward the second end of the waveguide.

Each of the coupling means comprises a rectangular waveguide having a pair of opposed narrow walls and a pair of opposed broad walls, the width of a narrow wall being less than the width of a broad wall, the rectangular waveguide having an input port for receiving a B-channel signal. Also included within the coupling means is a filter assembly including plural cylindrical cavity filters interconnecting one of the broad walls of the rectangular waveguide with a wall of the square waveguide. A B-channel signal is coupled by the filter assembly from the rectangular waveguide to the square waveguide. Also, the filter assembly has a plurality of slotted apertures disposed at interfaces between the filter assembly and the square waveguide for coupling directionally a B-channel signal into the square waveguide to propagate towards the second end of the square waveguide.

In a first embodiment of the invention, the filter assembly of the coupling means comprises a first filter and a second filter. The two waveguides are parallel. The first filter connects between a broad wall of the rectangular waveguide and a sidewall of the square waveguide. The second filter connects between a sidewall of the rectangular waveguide and a bottom wall of the square waveguide. An interface between an end of the first filter and the rectangular waveguide and an interface between an end of the second filter and the square waveguide comprise, respectively, a first slotted end aperture extending transversely of the rectangular waveguide and a second slotted end aperture extending transversely of the square waveguide for coupling electromagnetic power through the interfaces. An interface between a side of the first filter and the square waveguide and an interface between a side of the second filter and the rectangular waveguide comprise, respectively, a first slotted side aperture extending parallel to a longitudinal axis of the square waveguide and a second slotted side aperture extending parallel to a longitudinal axis of the rectangular waveguide for coupling electromagnetic power through the interfaces.

In a second embodiment of the invention, the filter assembly of the coupling means again comprises a first filter and a second filter. However, the two waveguides are perpendicular at the location of the coupling means. The first filter connects between a broad wall of the rectangular waveguide and a sidewall of the square waveguide. The second filter connects between a narrow wall of the rectangular waveguide and a top wall of the square waveguide. An interface between a side of the first filter and a broad wall of the rectangular waveguide and an interface between a side of the second filter and a narrow wall of the rectangular waveguide comprise, respectively, a first slotted side aperture extending transversely of the rectangular waveguide and a second slotted side aperture extending parallel to a longitudinal axis of the rectangular waveguide for coupling electromagnetic power through the interfaces An interface between an end of the first filter and the square waveguide and an interface between an end of the second filter and the square waveguide comprise, respectively, a first slotted end aperture extending parallel to a longitudinal axis of the square waveguide and a second slotted end aperture extending transversely of the square waveguide for coupling electromagnetic power through the interfaces.

BRIEF DESCRIPTION OF THE DRAWING

The aforementioned aspects and other features of the invention are explained in the following description, taken in connection with the accompanying drawing wherein.

DETAILED DESCRIPTION

Figure 1:
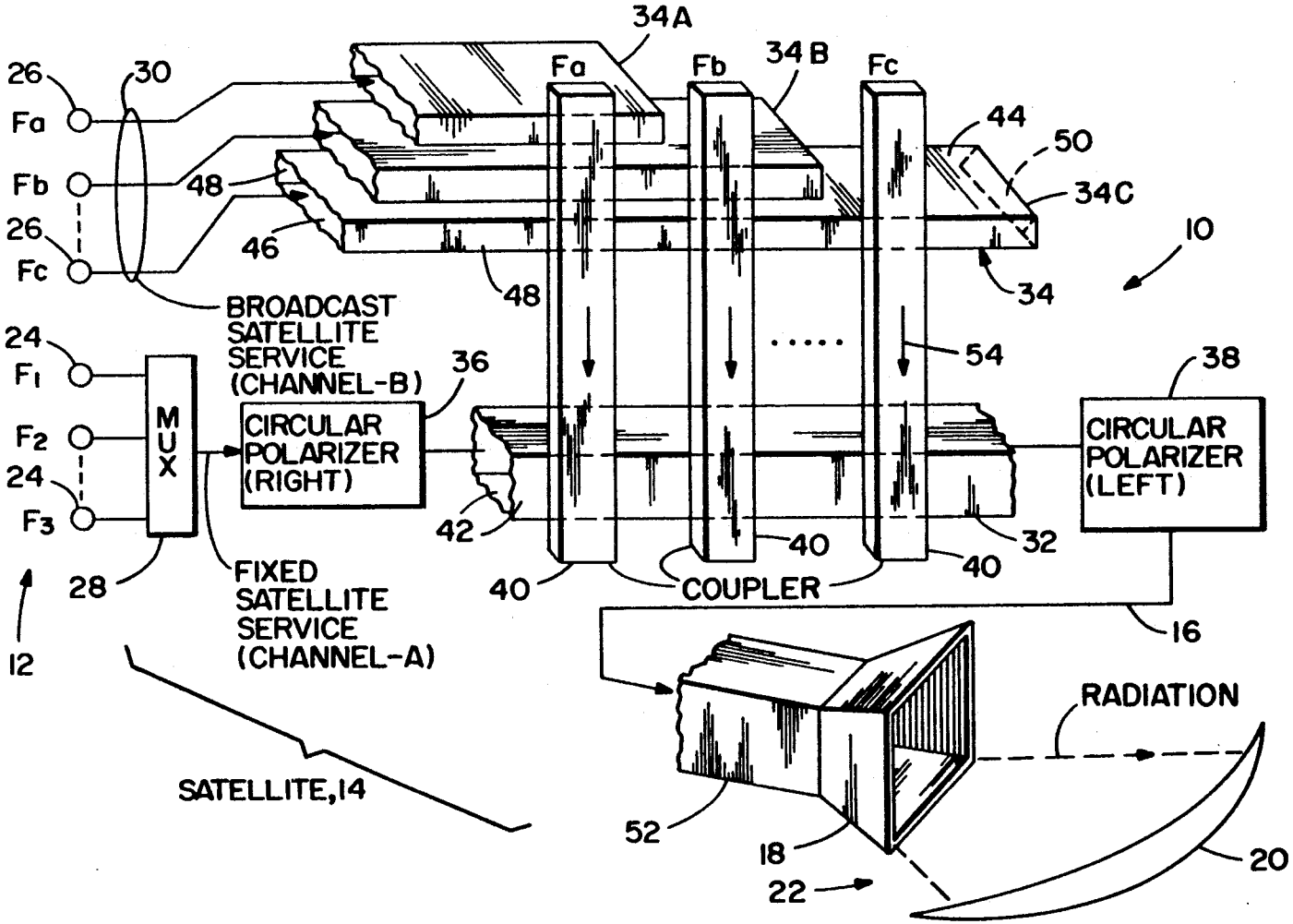
FIG. 1 is a diagrammatic view of a portion of a satellite communication system showing the multiplexing of two sets of signals by a set of microwave couplers constructed in accordance with the invention.

FIG. 1 shows a multiplexer system 10 constructed in accordance with the invention and being employed as a part of a communication system 12 employing a satellite 14 for communicating with stations (not shown) on the earth. While the multiplexer system 10 is useful in numerous forms of communication systems and also in signal processing systems, it is particularly advantageous for a satellite communication system because of its mechanical simplicity and because the multiplexer system 10 is capable of outputting both linearly and circularly polarized electromagnetic waves along a single path 16. In the case of the satellite communication system 12, the path 16 couples multiplexed signals to a feed horn 18 for illuminating a reflector 20 of an antenna 22. To simplify the drawing, only a fragment of the reflector 20 is indicated in the drawing. The feed horn 18 has a square-shaped radiating aperture suitable for radiation of both a linearly polarized wave and a circularly polarized wave from a common focal point of the antenna 22. If desired, an aperture of circular cross section (not shown) may be employed, along with a waveguide transition from square to circular cross section, for illuminating the reflector 20.

The communication system 12 is operative with two forms of communication signals commonly employed in satellite communication, namely, the fixed satellite service (FSS) wherein the signal is radiated as a linearly polarized wave, and broadcast satellite service (BSS) wherein the signal is radiated as a circularly polarized wave. The FSS and the BSS signals are presented by way of example, it being understood that the multiplexer system 10 is operative, in general, with a first input signal channel, Channel A, and a second input signal channel B, wherein each of the channels includes a plurality of signals offset from each other in the frequency spectrum by use of different carrier frequencies for each of the signals. By way of example, three such carrier frequencies are indicated for each of the channels. In Channel A, the three frequencies are shown as F1, F2, and F3. In channel B, the carrier frequencies are indicated as Fa, Fb, and Fc.

In the case of satellite communication, the signals are transmitted, generally, from an earth station to the satellite 14 to be amplified by well-known amplification means (not shown) on board the satellite 14, this being followed by retransmission back to the earth. The signals, subsequent to their amplification are indicated in FIG. 1 as being produced by signal sources 24 for the A-channel signals and signal sources 26 for the B-channel signals. By way of example, three of the sources 24 and three of the sources 26 are shown, it being understood that many more signals would be applied, in a typical situation, to each of the channels. Signals of the sources 24 are combined by a multiplexer 28 and applied to the A channel. Signals of the sources 26 are presented as a group 30 of separate signal transmission paths which, in a preferred embodiment of the invention, are constructed as a set of individual rectangular waveguides 34 of which three waveguides 34A, 34B and 34C are shown by way of example. Thus, each of channels has a plurality of signals at differing frequencies.

The multiplexer system 10 comprises a square waveguide 32 having a square cross section, the set of rectangular waveguides 34 each of which has a rectangular cross section, a circular polarizer 36 introducing a circular polarization to an electromagnetic wave, a circular polarizer 38 which introduces a circular polarization to an electromagnetic wave orthogonal to the polarization of the polarizer 36, and a plurality of couplers 40. There is one coupler 40 for each of the signal frequencies of the B channel, each of the couplers 40 being tuned to a specific one of the frequencies of the B-channel signals. The couplers 40 are identified further by the legends Fa, Fb and Fc, and are coupled respectively to corresponding ones of the waveguides 34A, 34B and 34C. In the square waveguide 32, there are four sidewalls 42, each of which have equal width. In each rectangular waveguide 34, there is a top wall 44 and a bottom wall 46 which are of equal width, and two opposed narrow walls 48 which are of equal width. Typically, the width of the top wall 44 is twice the width of a narrow wall 48.

In the operation of the multiplexer system 10, the signals entering the rectangular waveguides 34 from the signal sources 26 are linearly polarized with the electric field being parallel to a narrow wall 48 in respective ones of the waveguides 34. The signals outputted by the multiplexer 28 are also linearly polarized upon application to an input port of the polarizer 36, and are converted by the polarizer 36 to a circularly polarized wave which enters into the square waveguide 32. Signals entering the rectangular waveguides 34 propagate from a first end of each waveguide 34 at a source 26 towards the opposite end of the waveguide 34 wherein there is located a load 50 having an impedance matched to that of the waveguide 34 for absorbing microwave power so as to inhibit the generation of reflections of power flow in the reverse direction within the waveguide 34. In the square waveguide 32, electromagnetic power outputted by the polarizer 36 flows through the square waveguide 32 in a direction towards the polarizer 38. With respect to the A-channel signals, the circular polarization introduced by the polarizer 36 is negated by the circular polarization of the opposite hand introduced by the polarizer 38 so that the A-channel signals are restored to their state of linear polarization in the path 16. The path 16 is constructed as a section of square waveguide as is the input section 52 of the feed horn 18. With respect to the signals of the B-channel, the various signals are coupled by respective ones of the couplers 40 from the rectangular waveguides 34 to the square waveguide 32. Each of the couplers 40 operates in a directional fashion to launch its respective B-channel signal in the square waveguide 32 in the same direction of propagation in which the the A-channel signals propagate. Arrows 54 in the couplers 40 indicate the direction of propagation of the B-channel signals through the couplers 40.

Figure 2:
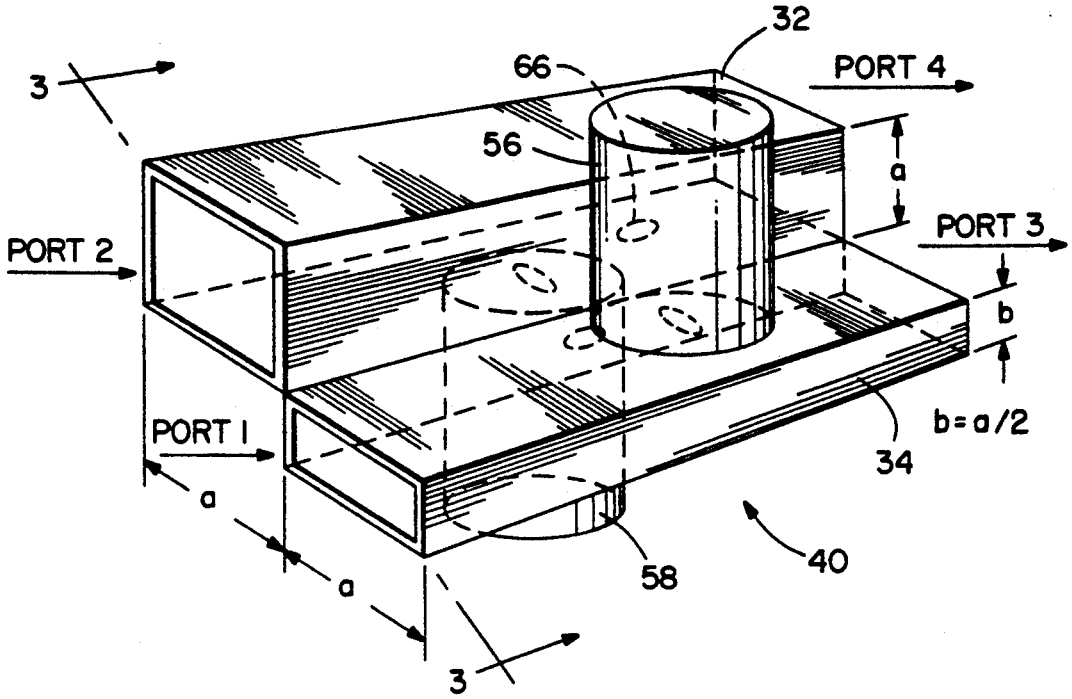
FIG. 2 is a perspective view of a coupler of FIG. 1 in accordance with a first embodiment of the invention.
Figure 3:
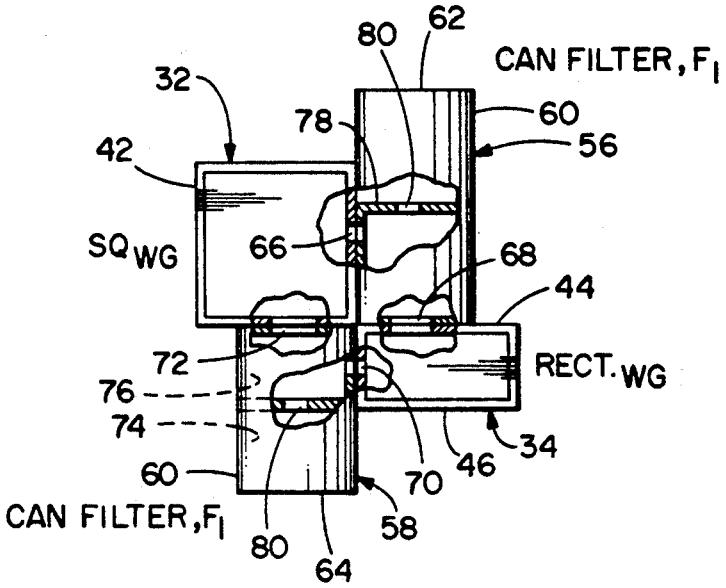
FIG. 3 is an end view of the coupler of FIG. 2 taken along the line 3—3 in FIG. 2, portions of the figure being cut away to show coupling apertures.

FIGS. 2 and 3 show the construction of a coupler 40 in accordance with a first embodiment of the invention. In addition to sections of each of the waveguides 32 and 34, each coupler 40 further comprises two cylindrical cavity filters 56 and 58 interconnecting the two waveguides 32 and 34. Each of the filters 56 and 58 comprises a sidewall 60, a top end wall 62 and a bottom end wall 64. In the case of the first filter 56, the sidewall 60 is provided with a first aperture 66 which extends through a sidewall 42 of the square waveguide 32 for communicating electromagnetic power between the filter 56 and the square waveguide 32. The aperture 66 is in the form of an elongated slot, and is shown in phantom in FIG. 2, and is also shown in a cut-away portion of FIG. 3. A second aperture 68 is formed in a bottom end wall 64 of the first filter 56, and continues through the top wall 44 of the waveguide 34 to couple power between the filter 56 and the waveguide 34. The second aperture 68 has the configuration of an elongated slot. A third aperture 70 having the shape of an elongated slot is formed within the sidewall 60 of the second filter 58 and extends through a narrow wall 48 of the waveguide 34 to couple power between the second filter 58 and the waveguide 48. A fourth aperture 72 having the form of an elongated slot is formed in the top end wall 62 of the second filter 58 and extends through a sidewall 42 of the square waveguide 32 for coupling power between the second filter 58 and the waveguide 32.

The orientations of the respective apertures 66–72 provide for magnetic coupling via the H components of the various electromagnetic fields in the respective waveguides 32 and 34 and filters 56 and 58. Typically, each cf the filters 56 and 58 comprises two cavities 74 and 76 separated by a transverse plate 78 having a coupling iris 80, such as a circular iris. The design of a two-cavity filter is well known. Furthermore, the number of cavities, whether there be one cavity, two cavities, or more cavities, is a matter of choice, the decision being based on a desired characteristic to the pass band of the respective couplers 40. For example, a more sharply defined pass band is required for closely spaced frequencies of the various B-channel signals, whereas less sharply defined pass bands may be employed when the signal frequencies are spaced further apart along the spectrum.

In each of the couplers 40, the two waveguides 32 and 34 are parallel to each other in this embodiment of the invention. All four of the slots 66–72 are disposed in a common plane oriented transversely to the longitudinal axes of the two waveguides 32 and 34. The second aperture 68 disposed in the bottom end wall 64 of the first filter 56 and the fourth aperture 72 disposed in the top end wall 62 of the filter 58 are disposed with their longitudinal dimensions oriented transversely to the longitudinal axes of the waveguides 32 and 34. The first aperture 66 disposed in the sidewall 60 of the first filter 56 and the third aperture 70 disposed in the sidewall 60 of the second filter 58 are disposed with their longitudinal dimensions parallel to the longitudinal axes of the waveguides 32 and 34.

Figure 4:
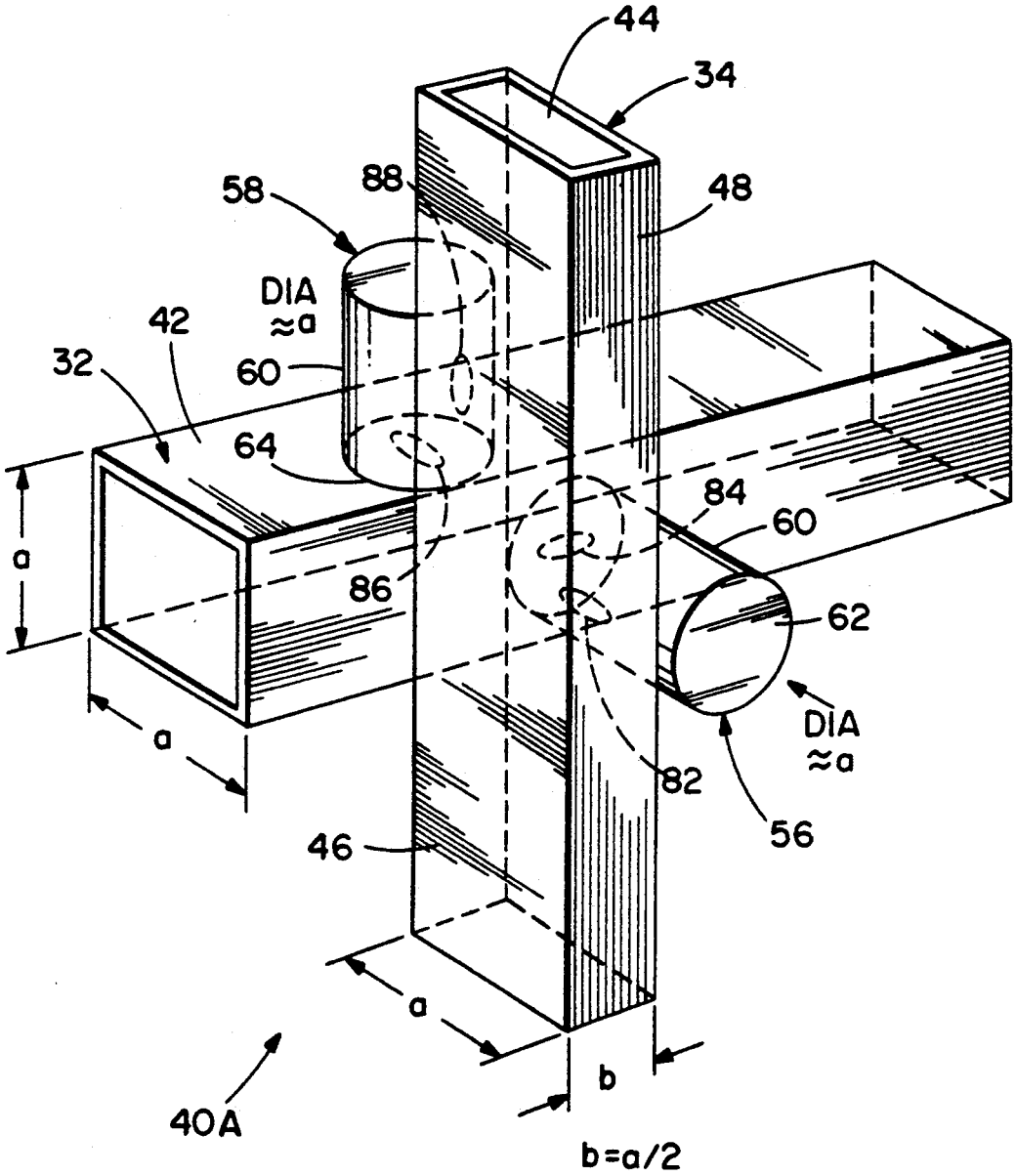
FIG. 4 is a perspective view of a coupler of FIG. 1 in accordance with a second embodiment of the invention.

In FIG. 4, there is a shown a coupler 40A which is an alternative embodiment to the coupler 40 of FIGS. 2 and 3. In FIG. 4, the rectangular waveguide 34 is oriented perpendicularly to the square waveguide 32. The two filters 56 and 58 are employed for coupling electromagnetic power between the two waveguides 32 and 34. However, the orientation of the two filters 56 and 58 differs from that shown in FIGS. 2 and 3. In FIG. 4, the bottom end wall 64 of each of the filters 56 and 58 contacts a sidewall 42 of the square waveguide 32. Sidewalls 60 of the filters 56 and 58 contact, respectively, the top wall 44 and a narrow wall 48 of the rectangular waveguide 34. There are four coupling apertures 82, 84, 86 and 88 providing for coupling of electromagnetic power from the waveguide 34 to the waveguide 32 via the two filters 56 and 58. A first aperture 82 having the shape of an elongated slot passes through the sidewall 60 of the first filter 56 and through the top wall 44 of the rectangular waveguide 34, the first aperture 82 being oriented in a direction transverse to the longitudinal axis of the rectangular waveguide 34. The second aperture 84 passes through the bottom end wall of the first filter 56 and through a sidewall 42 of the square waveguide 32, the second aperture 84 having the configuration of an elongated slot with longitudinal dimension parallel to an axis of the square waveguide 32. The third aperture 86 is disposed in a bottom end wall 64 of the second filter 58 and passes through a further sidewall 42 of the square waveguide 32, the third aperture 86 having the configuration of an elongated slot with longitudinal dimension transverse to the longitudinal axis of the square waveguide 32. The fourth aperture 88 is disposed in the sidewall 60 of the second filter 58 and passes through a narrow wall 48 of the rectangular waveguide 34, the fourth aperture 88 having the configuration of an elongated slot with longitudinal dimension parallel to the longitudinal axis of the rectangular waveguide 34.

Also indicated in FIG. 4 are transverse dimensions of the waveguides 32 and 34, the transverse dimension, or width, of a sidewall 32 of the square waveguide 32 being identified by the letter a. Also, the top wall 44 and the bottom wall 46 of the rectangular waveguide 34 have a width equal to the dimension a. The narrow walls 48 of the rectangular waveguide 34 have a width b where b is equal to one-half of a. The diameter of each of the filters 56 and 58 is approximately equal to the dimension a. If desired, the filters 56 and 58 can be constructed with a plurality of cavities as has been disclosed in FIG. 3.

The preceding description has provided for the construction of a multiplexer system suitable for combining dual signal channels wherein each channel has plural signals with differing frequencies. The construction of the multiplexer system provides for a combination of both of the signal channels to propagate along a common path suitable for an antenna feed. Furthermore, the combining is accomplished in the fashion which provides for linear polarization of the signals of one channel and circular polarization of the signals of the other channel.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A system for combining a plurality of electromagnetic signals to propagate along a common path, the system being operative with a plurality of sets of signal channels including a first set of circularly polarized A-channel signals and a second set of linearly polarized B-channel signals, the system comprising:

a transmission line having a first end and a second end opposite said first end, a circular polarizer having an input port and an output port, the output port being connected to the first end of said transmission line, all of said A-channel signals being fed into the input port of said polarizer, the A-channel signals differing in frequency and the B-channel signals differing in frequency, all of the A-channel signal frequencies and all of the B-channel signal frequencies falling within a pass band of said transmission line, and all of the A-channel signals propagating through said polarizer and along said transmission line to the second end of said waveguide;

a plurality of couplers located at positions arranged serially along said transmission line, individual ones of said couplers operating at different ones of the B-channel frequencies for selectively coupling respective ones of said B-channel signals into said transmission line to propagate toward the second end of said transmission line.

2. The system of claim 1 wherein the transmission line comprises a symmetric waveguide, wherein each of said couplers comprises a rectangular waveguide having a pair of opposed narrow walls and a pair of opposed broad walls, the width of a narrow wall being less than the width of a broad wall, the rectangular waveguide having an input port for receiving a B-channel signal; and wherein each of said couplers further comprises a filter assembly including plural cylindrical cavity filters interconnecting one of said broad walls of said rectangular waveguide with a first wall of said symmetric waveguide and one of said narrow walls of said rectangular waveguide with a second wall of said symmetric waveguide, the second wall of said symmetric waveguide being perpendicular to the first wall of said symmetric waveguide, the B-channel signal being coupled by said filter assembly from said rectangular waveguide to said symmetric waveguide.

3. A system according to claim 2 wherein said filter assembly has a plurality of slotted apertures disposed at interfaces between said filter assembly and said symmetric waveguide for coupling directionally the B-channel signal into the symmetric waveguide to propagate towards the second end of said symmetric waveguide.

4. A system according to claim 3 wherein, in said couplers, said filter assembly comprises a first and a second of said cylindrical cavity filters, said symmetric waveguide comprises opposed top and bottom walls and opposed sidewalls, said first filter connects between a broad wall of said rectangular waveguide and a sidewall of said symmetric waveguide, said second filter connects between a narrow wall of said rectangular waveguide and a bottom wall of said symmetric waveguide.

5. A system according to claim 4 wherein an interface between an end of said first filter and said rectangular waveguide and an interface between an end of said second filter and said symmetric waveguide comprise, respectively, a first slotted end aperture extending transversely of said rectangular waveguide and a second slotted end aperture extending transversely of said symmetric waveguide for coupling electromagnetic power.

6. A system according to claim 2 wherein an interface between a side of said first filter and said symmetric waveguide and an interface between a side of said second filter and said rectangular waveguide comprise, respectively, a first slotted side aperture extending parallel to a longitudinal axis of said symmetric waveguide and a second slotted side aperture extending parallel to a longitudinal axis of said rectangular waveguide for coupling electromagnetic power.

7. A system according to claim 6 wherein an interface between an end of said first filter and said rectangular waveguide and an interface between an end of said second filter and said symmetric waveguide comprise, respectively, a first slotted end aperture extending transversely of said rectangular waveguide and a second slotted end aperture extending transversely of said symmetric waveguide for coupling electromagnetic power.

8. A system according to claim 7 wherein said circular polarizer rotates the electric field of an electromagnetic wave propagating along said symmetric waveguide in a first direction of rotation, said system including a second circular polarizer having an input port and an output port and being coupled via its input port to he second end of said symmetric waveguide, said second circular polarizer rotating the electric field of an electromagnetic wave propagating along said symmetric waveguide in a second direction of rotation opposite said first direction of rotation, thereby restoring A-channel signals to linear polarization and imparting a circular polarization to B-channel signals.

9. A system according to claim 8 wherein the rectangular waveguide in one of said couplers connects with the rectangular waveguide in a second of said couplers, to form a continuous feed waveguide for feeding B-channel signals to said symmetric waveguide, said feed waveguide being parallel to said symmetric waveguide.

10. A system according to claim 9 further comprising a horn radiator having a symmetric cross section coupled to the output port of said second polarizer.

11. A system according to claim 3 wherein, in each of said couplers, said filter assembly comprises a first and a second of said cylindrical cavity filters, said rectangular waveguide is perpendicular to said symmetric waveguide, and said symmetric waveguide comprises opposed top and bottom walls and opposed sidewalls; and said first filter connects between a broad wall of said rectangular waveguide and a sidewall of said symmetric waveguide, and said second filter connects between a narrow wall of said rectangular waveguide and a top wall of said symmetric waveguide.

12. A system according to claim 11 wherein a first interface between a side of said first filter and a broad wall of said rectangular waveguide and a second interface between a side of said second filter and a narrow wall of said rectangular waveguide comprise, respectively, a first slotted side aperture extending transversely of said rectangular waveguide and a second slotted side aperture extending parallel to a longitudinal axis of said rectangular waveguide for coupling electromagnetic power through the first and the second interfaces; and a third interface between an end of said first filter and said symmetric waveguide and a fourth interface between an end of said second filter and said symmetric waveguide comprise, respectively, a first slotted end aperture extending parallel to a longitudinal axis of said symmetric waveguide and a second slotted end aperture extending transversely of said symmetric waveguide for coupling electromagnetic power through the third and the fourth interfaces.

13. A system according to claim 1 wherein said circular polarizer rotates the electric field of an electromagnetic wave propagating along said transmission line in a first direction of rotation, said system including a second circular polarizer having an input port and an output port and being coupled via its input ports to the second end of said transmission line, said second circular polarizer rotating the electric field of an electromagnetic wave propagating along said transmission line in a second direction of rotation opposite said first direction of rotation, thereby restoring A-channel signals to linear polarization and imparting a circular polarization to B-channel signals.

14. A system according to claim 13 further comprising a horn radiator having a symmetric cross section coupled to the output port of said second polarizer.

* * * * *